US009541851B2

(12) United States Patent
Kmiecik-Lawrynowicz et al.

(10) Patent No.: US 9,541,851 B2
(45) Date of Patent: Jan. 10, 2017

(54) LOW ENERGY CONSUMPTION MONOCHROME PARTICLE FOR SINGLE COMPONENT DEVELOPMENT SYSTEM

(71) Applicant: XEROX CORPORATION, Norwalk, CT (US)

(72) Inventors: Grazyna E. Kmiecik-Lawrynowicz, Fairport, NY (US); Robert D. Bayley, Fairport, NY (US); Maura A. Sweeney, Irondequoit, NY (US); Daniel A. Asarese, Honeoye Falls, NY (US); Susan J. Lafica, Fairport, NY (US)

(73) Assignee: XEROX CORPORATION, Norwalk, CT (US)

( * ) Notice: Subject to any disclaimer, the term of this patent is extended or adjusted under 35 U.S.C. 154(b) by 125 days.

(21) Appl. No.: 14/095,927

(22) Filed: Dec. 3, 2013

(65) Prior Publication Data

US 2015/0153672 A1 Jun. 4, 2015

(51) Int. Cl.

| | |
|---|---|
| ***G03G 9/00*** | (2006.01) |
| ***G03G 9/093*** | (2006.01) |
| ***G03G 9/09*** | (2006.01) |
| ***G03G 9/08*** | (2006.01) |

(52) U.S. Cl.

CPC ..... *G03G 9/0904* (2013.01); *G03G 9/0819* (2013.01); *G03G 9/0827* (2013.01); *G03G 9/09321* (2013.01); *G03G 9/09357* (2013.01); *G03G 9/09364* (2013.01); *G03G 9/09378* (2013.01); *G03G 9/09385* (2013.01)

(58) Field of Classification Search

CPC ..... G03G 9/00; G03G 9/0819; G03G 9/0821; G03G 9/08782; G03G 9/09

USPC ..... 430/109.3, 110.2, 108.8, 123.54, 123.57

See application file for complete search history.

(56) References Cited

U.S. PATENT DOCUMENTS

| | | | | |
|---|---|---|---|---|
| 5,928,830 | A * | 7/1999 | Cheng et al. | 430/137.12 |
| 2008/0044754 | A1* | 2/2008 | Marcello et al. | 430/110.2 |
| 2009/0081572 | A1* | 3/2009 | Kmiecik-Lawrynowicz | G03G 9/0806 430/107.1 |
| 2013/0260303 | A1 | 10/2013 | Kmiecik-Lawrynowicz | |

* cited by examiner

*Primary Examiner* — Thorl Chea

(57) ABSTRACT

A low energy consumption monochrome particle includes a core latex having a core a glass transition temperature and a weight average molecular weight. A shell encapsulates the core and includes a shell latex having a shell glass transition temperature and a weight average molecular weight. The glass transition temperature of the shell latex is higher than the glass transition temperature of the core latex. The weight average molecular weight of the shell latex is lower or higher than the weight average molecular weight of the core latex. The low energy consumption monochrome particles are suitable for high speed printing in SCD systems while decreasing minimum fusing temperature, maintaining excellent hot offset and storage, and exhibiting a matte finish.

20 Claims, No Drawings

LOW ENERGY CONSUMPTION MONOCHROME PARTICLE FOR SINGLE COMPONENT DEVELOPMENT SYSTEM

TECHNICAL FIELD

This disclosure is generally directed to toner particles for use such as in a single component development system (SCD system). More specifically, this disclosure is directed to low energy consumption monochrome particles exhibiting low minimum fusing temperature and low gloss levels, and methods for producing such particles.

BACKGROUND

High speed single component development systems (SCD systems) have been built to satisfy the high demands of an office network market. In SCD systems, an electrostatic latent image is formed on a photoconductor to which toner is attracted. The toner is then transferred to a support material, such as a piece of paper, and then fused to the support material by heat, forming an image. As printing demands increase, printers are required to print at higher speeds; thus, the toner must be heat/pressure fused to the paper in ever shortening times. A solution is to use toner with a lower melting temperature to overcome this problem. However, lower melting temperature toners tend to fuse together during storage.

There remains a need for an improved, low energy consumption monochrome particle suitable for high speed printing, particularly in SCD systems, and that can provide excellent flow, charging, lower toner usage, and reduced drum contamination, while producing gloss levels suitable for a matte finish after printing.

SUMMARY

The following detailed description is of the best currently contemplated modes of carrying out exemplary embodiments herein. The description is not to be taken in a limiting sense, but is made merely for the purpose of illustrating the general principles of the disclosure herein, since the scope of the disclosure herein is best defined by the appended claims.

Various inventive features are described below that can each be used independently of one another or in combination with other features. However, any single inventive feature may not address any of the problems discussed above or may only address one of the problems discussed above. Further, one or more of the problems discussed above may not be fully addressed by any of the features described below.

Broadly, embodiments of the present disclosure herein generally provide a low energy consumption monochrome toner particle comprising a core having a core latex including a single latex or mixture of latexes, a single low melt wax or mixture of waxes, a coagulant agent, a single colorant or mixture of colorants, and a chelating agent; the core latex has a weight average molecular weight (Mw) of from about 15 kpse to about 75 kpse and a glass transition temperature (Tg) of from about 35° C. to about 75°. Herein, "kpse" means the average molecular weight determined by size exclusion chromatography according to polystyrene equivalents (pse) multiplied by 1000 (k).

In another aspect of the present disclosure herein, a low energy consumption monochrome toner particle comprises a core latex having a core weight average molecular weight (Mw) and a core glass transition temperature (Tg); and a shell latex over the core latex and having a shell weight average molecular weight (Mw) and a shell glass transition temperature (Tg); the core Mw is higher or lower than the shell Mw, and the core Tg is lower than the shell Tg.

In another aspect of the present disclosure herein, a low energy consumption monochrome toner particle comprises a core, and a shell having a shell latex that has a weight average molecular weight (Mw) of from about 15 kpse to about 75 kpse and a glass transition temperature (Tg) of from about 50° C. to about 70°.

DETAILED DESCRIPTION

In the present disclosure, the term "high speed printing" refers to printing devices running at greater than about 35 pages per minute.

In the present disclosure, the term "low energy consumption particles" refers to toner particles that enable the use of a cooler fuser in a printing system and, therefore, less energy is consumed.

In the present disclosure, the term "hot offset temperature" refers to the maximum temperature at which toner does not significantly adhere to a fuser roll during fixing in a printing system.

In the present disclosure, the term "drum contamination" refers to an unacceptable amount of toner particles adhered on a drum of a printing system after fusing.

In the present disclosure, the term "minimum fusing temperature" refers to the minimum temperature at which acceptable adhesion of the toner to a substrate occurs in a printing system.

In the present disclosure, the term "matte finish" refers to gloss values (GGUs) of about 10 to about 25.

The present disclosure provides low energy consumption monochrome particles suitable for printing in SCD systems, improved hot offset temperature and storage stability (blocking resistance), and a matte finish. The present disclosure also provides methods for producing low energy consumption monochrome particles.

SUMMARY

The low energy consumption monochrome particles herein may have a core configuration. The core may include a latex containing one or more monomers, a low melt wax, a colorant including carbon black pigment and cyan blue, a coagulant agent, and a chelating agent, In other embodiments, the low energy consumption monochrome particles herein may have a core-shell structure. Included with the above core may be a low melt wax, a coagulant agent and a chelating agent. The shell may include a latex having a lower or higher weight average molecular weight (Mw) and a lower or higher glass transition temperature (Tg) than the latex in the core of the particle.

While the latex polymer may be prepared by any method within the purview of those skilled in the art, in embodiments herein, the latex polymer may be prepared by emulsion polymerization methods, including semi-continuous emulsion polymerization.

In embodiments, using semi-continuous emulsion polymerization, the core of the particle can be prepared by forming a monomer emulsion comprising one or more monomers in the presence of a surfactant and distilled water. A portion of the monomer emulsion is heated and stirred for a predetermined time to allow seed particle formation. Then, the remaining monomer emulsion is added into the reactor. The monomer emulsion is stirred to complete the conversion of the monomer to form the polymerized latex. Then, the latex is mixed in a homogenizer mixed using a homogenizer with at least one colorant, a low melt wax, and distilled water. A solution containing a coagulant and $HNO_3$ is added to the reactor.

Once the core particle is formed, a shell may be added and formed over the core. In embodiments, the shell may be prepared by producing a shell latex according to semi-continuous emulsion polymerization as described above in the preparation of the core of the particle. The shell latex can be added drop-wise to the reactor containing the core. After the complete addition of the shell latex, the resulting particle slurry can be stirred and the pH adjusted. The core-shell particles can then be washed several times and dried.

Core of the Particle

Any latex resin may be utilized in forming the core of the particle according to embodiments herein. Such resins, in turn, may be made of any suitable monomer. In embodiments, the monomer used to form the core may be a low molecular weight monomer having a weight average molecular weight (Mw) of from about 15 kpse to about 75 kpse, or from about 20 kpse to about 55 kpse, or from about 30 kpse to about 50 kpse. The molecular weight may be measured by high flow or mixed bed gel permeation chromatography.

In various embodiments, a glass transition temperature (Tg) of the latex of the core may be from about 35° C. to about 75° C., or from about 40° C. to about 70° C., or from about 45° C. to about 55° C.

In addition, the monomer for the core may contain a carboxylic acid selected, for example, from the group comprised of, but not limited to, acrylic acid, methacrylic acid, itaconic acid, β-CEA, fumaric acid, maleic acid and cinnamic acid.

Examples of suitable monomers useful in forming a core latex polymer emulsion, and thus the resulting latex particles in the latex emulsion, include, but are not limited to, styrenes, acrylates, methacrylates, butadienes, isoprenes, acrylic acids, methacrylic acids, acrylonitriles, or combinations thereof.

In embodiments, the polymer may be formed from a mixture of monomers such as styrene, n-butylacrylate and beta carboxyethylacrylate at a ratio of, for example, from about 83/17/5 by parts to about 70/30/2 by parts, or from about 79/21/3 parts to about 65/35/2 parts, or from about 75/25/3 parts to about 70/30/2 parts.

Low Melt Wax

A low melt wax or waxes may be added during formation of the core latex resin. The low melt wax may be added to improve particular toner properties, such as particle shape, fusing characteristics, gloss, stripping, and high offset temperature. The low melt wax may help to decrease minimum fusing temperature, increase melt index flow (MFI), and aid in improved release of toner particles from the fuser roll. In embodiments, the low melt wax has a melting point of less than about 80° C., or about 47° C. to about 78° C., or less than about 76° C.

Suitable waxes include, for example, natural vegetable waxes, natural animal waxes, mineral waxes, synthetic waxes, and functionalized waxes. Natural vegetable waxes include, for example, carnauba wax, candelilla wax, rice wax, sumacs wax, jojoba oil, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes include, for example, Fischer-Tropsch wax; acrylate wax; fatty acid amide wax; silicone wax; polytetrafluoroethylene wax; polyethylene wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, diglyceryl distearate, dipropyleneglycol distearate, and triglyceryl tetrastearate; sorbitan higher fatty acid ester waxes, such as sorbitan monostearate; and cholesterol higher fatty acid ester waxes, such as cholesteryl stearate; polypropylene wax; and mixtures thereof.

In embodiments, the low melt wax may be, for example, paraffin (melting point 47° C.-65° C.), bamboo leaf (melting point 79° C.-80° C.), bayberry (melting point 46.7° C.-48.8° C.), beeswax (melting point 61° C.-69° C.), candelilla (melting point 67° C.-69° C.), cape berry (melting point 40.5° C.-45° C.), caranda (melting point 79.7° C.-84.5° C.), carnuba (melting point 83° C.-86° C.), castor oil (melting point 83° C.-88° C.), and Japan wax (melting point 48° C.-53° C.).

The low melt wax may be present in an amount of from about 1% to about 35% by weight of the toner core, or from about 3% to about 25% by weight of the core, or from about 10% to about 20% by weight of the core. In embodiments, the amount of low melt wax present in the core of the present disclosure may be about half of the amount of wax used in a core when using a high melt wax.

Colorant

The core herein may also contain one or more colorants. For example, colorants used herein may include pigment, dye, mixtures of pigment and dye, mixtures of pigments, mixtures of dyes, and the like. The colorant may comprise, for example, carbon black, magnetite, black, cyan, magenta, yellow, red, green, blue, brown, and mixtures thereof. In embodiments, suitable colorants include a carbon black pigment and cyan blue. The colorant(s) may be incorporated in an amount sufficient to impart the desired color to the toner.

Carbon black pigments may be present in particles herein to improve the image density. The carbon black pigment may be, for example, Carbon black products from Cabot® Corporation, for example: Black Pearl 1400, Black Pearls, Black Pearls 1000, Black Pearls 1100, Black Pearls 120, Black Pearls 130, Black Pearls 1300, Black Pearls 1300A73, Black Pearls 1400, Black Pearls 160, Black Pearls 2000, Black Pearls 280, Black Pearls 3200, Black Pearls 3500, Black Pearls 3550, Black Pearls 3700, Black Pearls 420, Black Pearls 430, Black Pearls 4350, Black Pearls 4560, Black Pearls 460, Black Pearls 4750, Black Pearls 480, Black Pearls 490, Black Pearls 6100, Black Pearls 700, Black Pearls 800, Black Pearls 8500, Black Pearls 880, Black Pearls 900, Black Pearls L; carbon black products from Regal®, for example: Regal 1250R, Regal 1330, Regal 1330R, Regal 250, Regal 250R, Regal 300, Regal 300R, Regal 330, Regal 330R, Regal 350R, Regal 400, Regal 400R, Regal 415R, Regal 500R, Regal 600, Regal 660, Regal 660R, Regal 700, Regal 85, Regal 99, Regal 991, Regal 99R, Regal Black 250R, Regal L, Regal R 330, Regal SRF, and Regal SRF-S; carbon blacks from Condutex®, for example: Conductex 40-200, Conductex 40-220, Conductex 7051, Conductex 7055 Ultra, Conductex 900, Conductex 950, Conductex 975, Conductex 975 Ultra, Conductex 975U, Conductex CC 40-220, Conductex N 472, Conductex SC, Conductex SC Ultra, and Conductex SC-U; carbon blacks from Columbian Chemicals, for example: Raven® carbon blacks such as Raven 1000, Raven 1000BDS, Raven 1020, Raven 1035, Raven 1040, Raven 1060, Raven 1060B, Raven 1080, Raven 11, Raven 1100, Raven 1100 Ultra, Raven 1170, Raven 1190 Ultra, Raven 1200, Raven 12200, Raven 125, Raven 1250, Raven 1255, Raven 1255B, Raven 14, Raven 15, Raven 150, Raven 1500, Raven 16, Raven 200, Raven 2000, Raven 22, Raven 22D, Raven 2500, Raven 2500 Powder U, Raven 2500 Ultra, Raven 30, Raven 3200, Raven 35, Raven 350, Raven 3500, Raven 360, Raven 3600 Ultra, Raven 3600U, Raven 40, Raven 403UB, Raven 410, Raven 410U, Raven 420, Raven 420 Dense, Raven 430, Raven 430 Ultra, Raven 430UB, Raven 450, Raven 50, Raven 500, Raven 5000, Raven 5000 Ultra 11, Raven 5000UIII, Raven 520, Raven 5250, Raven 5720, Raven 5750, Raven 7000, Raven 760, Raven 760 Ultra, Raven 760B, Raven 780, Raven 780 Ultra, Raven 8000, Raven 860, Raven 860 Ultra, Raven 860U, Raven 880 Ultra, Raven 890, Raven Beads, Raven Black, Raven C, and Raven P-FE/B; carbon blacks by LanXess®, for example: Levanyls® such as Levanyl B-LF, Levanyl Black A-SF, Levanyl Black B-LF, Levanyl Black BZ, Levanyl Black N-LF, and Levanyl N-LF (LanXess); carbon blacks by Mitsubishi®, for example: Mitsubishi 1000, Mitsubishi 20B, Mitsubishi 2400, Mitsubishi 2400B, Mitsubishi 258, Mitsubishi 260, Mitsubishi 2770B, Mitsubishi 30, Mitsubishi 3030, Mitsubishi 3050, Mitsubishi 30B, Mitsubishi 3150, Mitsubishi 33B, Mitsubishi 3400, Mitsubishi 40, Mitsubishi 44, Mitsubishi 45, Mitsubishi 47, Mitsubishi 50, Mitsubishi 5B, Mitsubishi 650, Mitsubishi 900, Mitsubishi 970, Mitsubishi 980B, Mitsubishi 990B, Mitsubishi Carbon 10, Mitsubishi Carbon 25, Mitsubishi Carbon 40, Mitsubishi Carbon 44, Mitsubishi Carbon 45, Mitsubishi Carbon 50, Mitsubishi Carbon 52, Mitsubishi Carbon Black 2000, Mitsubishi Carbon Black 2600, Mitsubishi Carbon Black 3050, Mitsubishi Carbon Black 33, Mitsubishi Carbon Black 44, Mitsubishi Carbon Black 900, Mitsubishi Carbon Black 950, Mitsubishi Carbon Black 970, Mitsubishi Carbon Black 990, Mitsubishi Carbon Black MA 100, and Mitsubishi Carbon Black MA 220; carbon blacks by NiPex®, for example: Nipex 150G, Nipex 15010, Nipex 16, Nipex 160, Nipex 16010, Nipex 18, Nipex 180, Nipex 18010, Nipex 30, Nipex 60, Nipex 70, Nipex 85, and Nipex 90; carbon blacks by BASF®, for example: Paliogen Violet 5100 and 5890; Normandy Magenta RD-2400 by Paul Uhlrich®; Permanent Violet VT2645 by Paul Uhlrich®; Heliogen Green L8730 by BASF®; Argyle Green XP-111-S by Paul Uhlrich®; Brilliant Green Toner GR 0991 by Paul Uhlrich®; Lithol Scarlet D3700 by BASF®; Toluidine Red by Aldrich®; Scarlet for Thermoplast NSD Red by Aldrich®; Lithol Rubine Toner by Paul Uhlrich®; Lithol Scarlet 4440 and NBD 3700 by BASF®; Bon Red C by Dominion Color® Royal Brilliant Red RD-8192 by Paul Uhlrich®; Oracet Pink RF by Ciba Geigy®; Paliogen Red 3340 and 3871K by BASF®; Lithol Fast Scarlet L4300 by BASF®; Heliogen Blue D6840, D7080, K7090, K6910 and L7020 by BASF®; Sudan Blue OS by BASF®; Neopen Blue FF4012 by BASF®; PV Fast Blue B2G01 by American Hoechst®; Irgalite Blue BCA by Ciba Geigy®; Paliogen Blue 6470 by BASF®; Sudan II, III and IV by Matheson, Coleman, and Bell; Sudan Orange by Aldrich®; Sudan Orange 220 by BASF®; Paliogen Orange 3040 by BASF®; Ortho Orange OR 2673 by Paul Uhlrich®; Paliogen Yellow 152 and 1560 by BASF®; Lithol Fast Yellow 0991K by BASF®; Paliotol Yellow 1840 by BASF®; Novaperm Yellow FGL by Hoechst®; Permanerit Yellow YE 0305 by Paul Uhlrich®; Lumogen Yellow D0790 by BASF®; Suco-Gelb 1250 by BASF®; Suco-Yellow D1355 by BASF®; Suco Fast Yellow D1165, D1355 and D1351 by BASF®; Hostaperm Pink E by Hoechst®; Fanal Pink D4830 by BASF®; Cinquasia Magenta by DuPont®; Paliogen Black L9984 9 by BASF®; and Pigment Black K801 by BASF®.

Carbon black may be present in the core of the present disclosure, for example, in an amount of from about 1% to about 8% by weight of core, or from about 2% to about 6% by weight of the core, or from about 3% to about 5% by weight of the core.

Cyan blue may improve the tint of the toner and may also help to add charge to the particles. The cyan blue may be present in the particle of the disclosure, for example, in an amount of from about 0.25% to about 3.25% by weight of core, or from about 0.5% to about 2.75% by weight of the core, or from about 0.75% to about 1.75% by weight of the core.

Coagulant Agent

A coagulant agent(s) may be added to the core herein to adjust the ionic crosslinking in the toner. In embodiments, an ionic crosslinker coagulant agent is added to the core. The ionic crosslinker coagulant agent may be added prior to aggregating the core latex, wax and the colorant. Suitable ionic crosslinker coagulant agents include, for example, coagulant agents based on aluminum such as polyaluminum halides including polyaluminum fluoride and polyaluminum chloride (PAC); polyaluminum silicates such as polyaluminum sulfosilicate (PASS); polyaluminum hydroxide; polyaluminum phosphate; aluminum sulfate; and the like. Other suitable coagulant agents include tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like.

In embodiments, the coagulant agent may be polyaluminum chloride.

The ionic crosslinker coagulant agent may be present in the core particles in amounts of from about 0.08 pph to about 0.28 pph, or from about 0.10 pph to about 0.20 pph, or from about 0.13 pph to about 0.17 pph.

Chelating Agent

A chelating agent(s) may be added to the particles herein to reduce the amount of ionic crosslinking, increase the melt flow, and lower the minimum fusing temperature. Suitable chelating agents may include, for example, ethylenediaminetetraacetic acid (EDTA), gluconal, hydroxyl-2,2'iminodisuccinic acid (HIDS), dicarboxylmethyl glutamic acid (GLDA), methyl glycidyl diacetic acid (MGDA), hydroxydiethyliminodiacetic acid (HIDA), sodium gluconate, potassium citrate, sodium citrate, nitrotriacetate salt, humic acid, fulvic acid; salts of EDTA, such as, alkali metal salts of EDTA, tartaric acid, gluconic acid, oxalic acid, polyacrylates, sugar acrylates, citric acid, polyasparic acid, diethylenetriamine pentaacetate, 3-hydroxy-4-pyridinone, dopamine, eucalyptus, iminodisuccinic acid, ethylenediaminedisuccinate, polysaccharide, sodium ethylenedinitrilotetraacetate, thiamine pyrophosphate, farnesyl pyrophosphate, 2-aminoethylpyrophosphate, hydroxyl ethylidene-1,1-diphosphonic acid, aminotrimethylenephosphonic acid, diethylene triaminepentamethylene phosphonic acid, ethylenediamine tetramethylene phosphonic acid, and mixtures thereof.

The chelating agent may be present in the core particles in amounts of from about 0.05% to about 1.00% by weight of the core, or from about 0.24% to about 0.84% by weight of the core, or from about 0.44% to about 0.64% by weight of the core.

Surfactant

One, two, or more surfactants may be used to form the core latex according to the present disclosure. The surfactant may be present in an amount of from about 0.01 to about 5% by weight of the core, or from about 0.75 to about 4% by weight of the core, or from about 1 to about 3% by weight of the core.

Suitable anionic surfactants include sulfates and sulfonates; sodium dodecylsulfate (SDS); sodium dodecylbenzene sulfonate; sodium dodecylnaphthalene sulfate; dialkyl benzenealkyl sulfates and sulfonates; acids such as abitic acid available from Aldrich; NEOGEN® and NEOGEN SC™ obtained from Daiichi Kogyo Seiyaku; combinations thereof; and the like. Other suitable anionic surfactants include DOWFAX™ 2A1, an alkyldiphenyloxide disulfonate from The Dow Chemical Company; and/or TAYCA POWER BN2060 from Tayca Corporation (Japan), which are branched sodium dodecyl benzene sulfonates. Combinations of these surfactants and any of the foregoing anionic surfactants may be used.

Examples of suitable nonionic surfactants include, for example, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol; nonionic surfactants available from Rhône-Poulenc including IGEPAL CA-210™, IGEPAL CA-520™, IGEPAL CA-720™, IGEPAL CO890™, IGEPAL CO720™, IGEPAL CO290™, IGEPAL CA-210™, ANTAROX 890™, and ANTAROX 897™. Other examples of suitable nonionic surfactants include a block copolymer of polyethylene oxide and polypropylene oxide, including those commercially available from SYNPERONIC PE/F®, including SYNPERONIC PE/F 108.

Shell of the Particle

The shell of the toner particles herein may include a latex prepared by the same method as that used to prepare the core. In embodiments, the latex of the shell may have a lower or higher weight average molecular weight (Mw) and higher glass transition temperature (Tg) than the latex of the core.

In embodiments, the Tg of the shell latex may be from about 35° C. to about 75° C., or from about 55° C. to about 65° C., or from about 58° C. to about 62° C. In embodiments, the Mw of the shell latex may be from about 15 kpse to about 60 kpse, or from about 20 kpse to about 55 kpse, or from about 30 kpse to about 50 kpse.

Useful components of the shell latex can include, for example, monomers, coagulants agents, chelating agents, and surfactants. Examples of the specific components and their respective amounts can be the same as those in the core latex.

Any method within the purview of those skilled in the art may be used to encapsulate the core within the shell, for example, by coacervation, dipping, layering, or painting. The encapsulation of the aggregated core particles may occur, for example, while heating to an elevated temperature in embodiments from about 80° C. to about 99° C., or from about 88° C. to about 98° C., or from about 90° C. to about 96° C. The formation of the shell may take place for a period of time from about 1 minute to about 5 hours, or from about 5 minutes to about 3 hours, or from about 15 minute to about 2.5 hours. The shell latex may be applied to the core until the desired final size of the toner particle is achieved.

Particle Characteristics

The toner particles according to the present disclosure in a core-shell configuration can have an average particle size from about 5 microns to about 10 microns, or from about 6 microns to about 9 microns, or from about 7 microns to about 8 microns. Particles larger than about 10 microns may tend to group together in the toner since the toner mass area density is lower. In addition, having a size smaller than about 5 microns may create a dust cloud that prevents the toner from having good development and thus producing blurry images.

In a core-shell configuration, the particles according to the present disclosure may have a circularity of from about 0.940 to about 0.999, or from about 0.950 to about 0.980, or from about 0.960 to about 0.970.

Example

The following Example illustrates one exemplary embodiment of the present disclosure. This Example is intended to be illustrative only to show one of several methods of preparing the low energy consumption monochrome particle and is not intended to limit the scope of the present disclosure. Also, parts and percentages are by weight unless otherwise indicated.

A monomer in water emulsion was prepared by agitating a monomer mixture of about 29 parts by weight styrene, about 9.8 parts by weight n-butyl acrylate, about 1.17 parts by weight beta-carboxyethylacrylate (Beta CEA), about 0.20 parts by weight 1-dodecanethiol with an aqueous solution of about 0.77 parts by weight of DOWFAX™ 2A1 (an alkyldiphenyloxide disulfonate surfactant sold by Dow Chemical), and about 18.5 parts by weight of distilled water at about 500 revolutions per minute (rpm) at a temperature of from about 20° C. to about 25° C.

About 0.06 parts by weight of DOWFAX™ 2A1 and about 36 parts by weight of distilled water were charged in an 8 liter jacketed glass reactor fitted with a stainless steel 45° pitch semi-axial flow impeller at about 200 rpm, a thermal couple temperature probe, a water cooled condenser with nitrogen outlet, a nitrogen inlet, internal cooling capabilities, and a hot water circulating bath set at about 83° C., and de-aerated for about 30 minutes while the temperature was raised to about 75° C.

About 1.2 parts by weight of the monomer emulsion described above was then added into the reactor and was stirred for about 10 minutes at about 75° C. An initiator solution prepared from about 0.78 parts by weight of ammonium persulfate in about 2.7 parts by weight of distilled water was added to the reactor over about 20 minutes. Stirring continued for about an additional 20 minutes to allow seed particle formation. The remaining monomer emulsion was then fed into the reactor over a time period of about 190 minutes. After the addition, the latex was stirred at the same temperature for about 3 more hours to complete conversion of the monomer. Latex made by the process of semi-continuous emulsion polymerization resulted in latex particle sizes between 150 nm to 250 nm.

Synthesis of EA Particle (Reference Particle)

To a 2 liter jacketed glass lab reactor, about 378 parts by weight of a core latex, which was prepared by the process of semi-continuous emulsion polymerization as described in the latex synthesis example, about 65 parts by weight of a Regal 330 pigment dispersion, about 22 parts by weight of a cyan pigment blue 15:3 pigment dispersion, about 184 parts by weight of a paraffin wax dispersion, and about 760 parts by weight of distilled water, were added. The components were mixed by a homogenizer for about 2-3 minutes at about 4000 rpm. With continued homogenization, a separate mixture of about 4.4 parts by weight of poly (aluminum chloride) in about 30 parts by weight of 0.02 M of $HNO_3$ solution was added drop-wise into the reactor. After the addition of the poly(aluminum chloride) mixture, the resulting viscous slurry was further homogenized at about 20° C. for about 20 minutes at about 4000 rpm. At this time the homogenizer was removed and replaced with a stainless steel 45° pitch semi-axial flow impeller and stirred continuously at about 350 to 300 rpm, while raising the temperature of the contents of the reactor to about 54.7° C. The batch was held at this temperature until a core particle size of about 6.9 microns was achieved.

A shell was added to the core by the following process. While stirring continuously at about 300 rpm, about 240 parts by weight of a shell latex, which was prepared by the process of semi-continuous emulsion polymerization described in the emulsion polymerization example, was added drop-wise, over a period of about 10 minutes, to the reactor containing the core particle having a particle size of about 6.9 microns. After the complete addition of the latex, the resulting particle slurry was stirred for about 30 minutes, at which time about 6.25 parts of tetra sodium salt of ethylenediaminetetraacetic acid and a sufficient amount of 1 molar NaOH was added to the slurry to adjust the pH of the slurry to about 5.7. After the pH adjustment, the stirrer speed was lowered to about 160 rpm for an additional 10 minutes. At the end of the 10 minutes, the bath temperature was adjusted to about 98° C. to heat the slurry to about 96° C. During the temperature increase, the pH of the slurry was adjusted to about 5.3 by the addition of a sufficient amount of a 0.3 M $HNO_3$ solution at about 80° C. The slurry temperature was then allowed to increase to about 96.1° C. and was maintained at 96.1° C. to complete coalescence in about 260 minutes. At this time, a sufficient amount of 1 molar NaOH was added to the particle slurry to adjust the pH to about 6.9, and the slurry was immediately cooled to about 63° C. Upon reaching 63° C., the particle slurry was again pH adjusted with a sufficient amount of 1 molar NaOH to obtain a pH of 8.8, followed by immediate cooling to about 30° C. to 35° C. At this time, the low energy consumption monochrome particles were washed several times and dried.

The resulting particles had an average diameter of 7.42 μm, a GSDv of 1.182, a GSDn of 1.21, and a circularity of 0.959. The glass transition temperature Tg of the particles was 47° C.

Tables I and II show the low energy consumption monochrome particles according to the present disclosure (Formulation 1) compared with a control. As can be seen from the table, the particles are very similar in size and shape. Surface wax is noted to be higher at room temperature, 50° C. and 75° C. This is shown to give improved minimum fusing as well as improved release. Once at 90° C. both particles show equivalent surface wax levels. BET is similar to the control, being an optimized particle shape for improved cleaning. The melt flow index (MFI) at 125° C. and 5 kg is increased from the control also, allowing for better flow and fusing. Tg of the material is similar to the control allowing for better storage stability. Molecular weights are low, also lending improved rheological characteristics when fused.

TABLE I

| Toner | Volume Number PS (um) | 84/50 GSD | 50/16 GSD | Circularity | XPS % wax on surface (RT) | % wax on surface (50 deg C.) | % wax on surface (75 deg C.) | % wax on surface (90 deg C.) |
|---|---|---|---|---|---|---|---|---|
| Formulation 1 (Low Melt) | 7.42 | 1.182 | 1.21 | 0.959 | 15 | 19 | 85 | 94 |
| Control | 7.55 | 1.181 | 1.2 | 0.960 | 12 | 16 | 63 | 93 |

TABLE II

| Toner | BET (m2/g) multi | BET (m2/g) single | MFI (125° C. 5.0 kg) (g/10 min) | Tg (onset) (° C.) | Midpt. Tg (° C.) | Mw (pse) | Mn (pse) | Mz (pse) | Mp (pse) | MWD |
|---|---|---|---|---|---|---|---|---|---|---|
| Formulation 1 (Low Melt) | 1.06 | 1.19 | 15.5 | 47 | 53.3 | 29,117 | 13,312 | 57,604 | 19,226 | 2.19 |
| Control | 1.09 | 0.991 | 9.5 | 46.6 | 53.4 | 31,101 | 13,693 | 65,300 | 19,628 | 2.27 |

It will be appreciated that variations of the above-disclosed and other features and functions, or alternatives thereof, may be desirably combined into many other different systems or applications. Also that various, presently unforeseen or unanticipated, alternatives, modifications, variations or improvements therein may be subsequently made by those skilled in the art which are also intended to be encompassed by the following claims.

What is claimed is:

1. A low energy consumption monochrome toner particle, comprising:

a) a core having:

a core latex having a weight average molecular weight (Mw) between 20 kpse and 55 kpse;

a wax component having a melting point of less than 80° C.;

a coagulant agent; and a colorant; and further comprising b) a shell over the core comprising a shell latex, wherein the shell latex has a weight average molecular weight (Mw) of from about 25 kpse to about 45 kpse and a glass transition temperature (Tg) of from 35° C. to 75° C., wherein the core latex is a polymer formed of a monomer mixture of styrene, n-buty acrylate, and beta-carboxyethylacrylate, wherein the toner particle produces a matte finish.

2. The low energy consumption monochrome toner particle claim 1, the core of said toner particle further comprising a chelating agent in amounts of from about 0.05% to about 1.00% by weight of the core, wherein the matte finish has a gloss value between 10 GGU and 25 GGU.

3. The low energy consumption monochrome particle of claim 1, wherein the low energy consumption monochrome particle is prepared according to a process using semi-continuous emulsion polymerization, comprising forming polymerized latex, mixing the polymerized latex with the colorant, the low melt wax, and distilled water, and adding solution containing the coagulant.

4. The low energy consumption monochrome particle of claim 1, wherein the wax component is paraffin wax present at between 1% to 35% by weight of the core latex.

5. The low energy consumption monochrome particle of claim 1, wherein the colorant includes a carbon black pigment and a cyan blue pigment.

6. The low energy consumption monochrome particle of claim 1, wherein the coagulant agent is polyaluminum chloride.

7. The low energy consumption monochrome particle of claim 1, the core of said particle further comprising a chelating agent, wherein the chelating agent is ethylenediaminetetraacetic acid.

8. A low energy consumption monochrome toner particle, comprising:

a core latex having a core weight average molecular weight (Mw) of between 25 kpse to about 55 kpse and a core glass transition temperature (Tg);

wherein the core latex is a polymer formed of a monomer mixture of styrene, n-butyl acrylate, and beta-carboxyethylacrylate;

a shell latex over the core latex having a shell weight average molecular weight (Mw) and a shell glass transition temperature (Tg) from about 35° C. to about 75° C.; and wherein said core latex further comprises a chelating agent in amounts of from about 0.05% to about 1.00% by weight of the core, wherein toner particle produces a matte finish having a gloss value between 10 GGU and 25 GGU wherein the core Tg is lower than the shell Tg.

9. The low energy consumption monochrome particle of claim 8, wherein the core latex further comprises:

a low melt wax, having a melting point of less than about 80° C.;

a coagulant agent; and a colorant.

10. The low energy consumption monochrome particle of claim 8, wherein the core latex has a glass transition temperature (Tg) of from about 35° C. to about 75° C.

11. The low energy consumption monochrome particle of claim 8, wherein the shell latex has a weight average molecular weight (Mw) of from about 25 kpse to about 45 kpse.

12. The low energy consumption monochrome particle according to claim 8, further comprising a colorant comprising carbon black and cyan blue.

13. The low energy consumption monochrome particle according to claim 8, wherein the particle has an average particle size of from about 5 microns to about 10 microns.

14. The low energy consumption monochrome particle according to claim 8, wherein the particle has a circularity of about 0.940 to about 0.999.

15. A low energy consumption monochrome toner, comprising:

a core latex having a core weight average molecular weight (Mw) of between 20 kpse and 55 kpse, and formed of a monomer mixture of styrene, n-butyl acrylate, and beta-carboxyethylacrylate;

a wax component consisting essentially of a low melt wax having a melting point of less than 80° C.;

a shell latex over the core latex, the shell latex having a Mw of between 25 and 45 kpse; and a colorant.

16. The low energy consumption monochrome toner of claim 15, further comprising:

a coagulant agent; and further comprising a core latex comprising a chelating agent in amounts of from about 0.05% to about 1.00% by weight of the core, wherein the toner produces a matte finish having a gloss value between 10 GGU and 25 GGU.

17. The low energy consumption monochrome toner particle of claim 15, wherein the colorant comprises carbon black and cyan blue.

18. The low energy consumption monochrome toner of claim 15, wherein the shell latex has a weight average molecular weight (Mw) of from about 25 kpse to about 45 kpse and a glass transition temperature (Tg) of from about 35° C. to about 75° C.

19. The low energy consumption monochrome toner according to claim 15, wherein the styrene, n-butylacrylate and beta carboxyethylacrylate are present at a respective ratio of from about 83/17/5 by parts to about 70/30/2 by parts.

20. The low energy consumption monochrome toner according to claim 15, wherein the wax.

* * * * *